US007758137B2

(12) United States Patent
Keller et al.

(10) Patent No.: US 7,758,137 B2
(45) **Date of Patent: *Jul. 20, 2010**

(54) NOZZLE DISTRIBUTION

(75) Inventors: David Keller, Seattle, WA (US); Ronald A. Askeland, San Diego, CA (US); Steve Steinfield, San Diego, CA (US); Wayne Richard, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 33 days.

This patent is subject to a terminal disclaimer.

(21) Appl. No.: 11/825,919

(22) Filed: Jul. 9, 2007

(65) Prior Publication Data

US 2007/0257952 A1 Nov. 8, 2007

Related U.S. Application Data

(63) Continuation of application No. 10/769,252, filed on Jan. 30, 2004, now Pat. No. 7,249,815.

(51) Int. Cl.
*B41J 29/38* (2006.01)
*B41J 2/15* (2006.01)
*B41J 29/393* (2006.01)

(52) U.S. Cl. ..... 347/6; 347/19; 347/20

(58) Field of Classification Search ..... 347/15, 347/19

See application file for complete search history.

(56) References Cited

U.S. PATENT DOCUMENTS 5,387,976 A * 2/1995 Lesniak ..... 347/19
6,109,723 A * 8/2000 Castle et al. ..... 347/19
6,375,294 B1 * 4/2002 Kneezel ..... 347/15
6,513,901 B1 * 2/2003 Walker ..... 347/19
6,655,775 B1 * 12/2003 Raman et al. ..... 347/19

* cited by examiner

*Primary Examiner*—Matthew Luu
*Assistant Examiner*—Shelby Fidler

(57) ABSTRACT

A fluid ejection device includes a die having a plurality of nozzles variously configured according to a predetermined intended distribution. The fluid ejection device also includes a controller configured to set a mean drop volume of the die by selectively firing selected nozzles of the die.

21 Claims, 6 Drawing Sheets

| TABLE 8 – Usage Pattern | | | | | | | | |
|---|---|---|---|---|---|---|---|---|
| | Die | | | | | | | |
| | A | | B | | C | | D | |
| | small | large | small | large | small | large | small | large |
| Intended Drop Volume | 5.0 | 7.0 | 5.0 | 7.0 | 5.0 | 7.0 | 5.0 | 7.0 |
| Actual Drop Volume | 5.4 | 7.3 | 4.5 | 6.2 | 5.2 | 7.6 | 5.1 | 6.9 |
| Uncalibrated Mean Drop Volume | 6.35 | | 5.35 | | 6.40 | | 6.00 | |
| Firing Ratio | 68% | 32% | 12% | 88% | 67% | 33% | 50% | 50% |
| Calibrated Mean Drop Volume | 6.00 | | 6.00 | | 5.99 | | 6.00 | |

FIG. 4
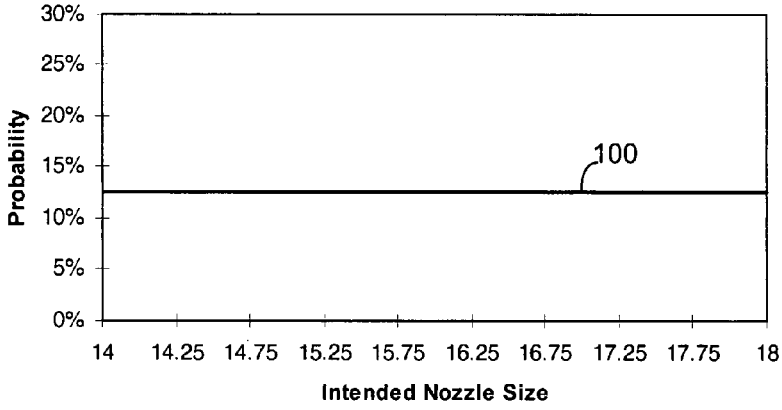
FIG. 5
| TABLE 1 – Uniform Probability Distribution | |
|---|---|
| Subinterval (micrometers) | Probability (%) |
| [14, 14.5) | 12.5 |
| [14.5, 15) | 12.5 |
| [15, 15.5) | 12.5 |
| [15.5, 16) | 12.5 |
| [16, 16.5) | 12.5 |
| [16.5, 17) | 12.5 |
| [17, 17.5) | 12.5 |
| [17.5, 18] | 12.5 |
FIG. 7
| TABLE 2 – Normal Probability Distribution | |
|---|---|
| Subinterval (micrometers) | Probability (%) |
| [14, 14.5) | 9 |
| [14.5, 15) | 10 |
| [15, 15.5) | 13 |
| [15.5, 16) | 18 |
| [16, 16.5) | 18 |
| [16.5, 17) | 13 |
| [17, 17.5) | 10 |
| [17.5, 18] | 9 |
FIG. 6
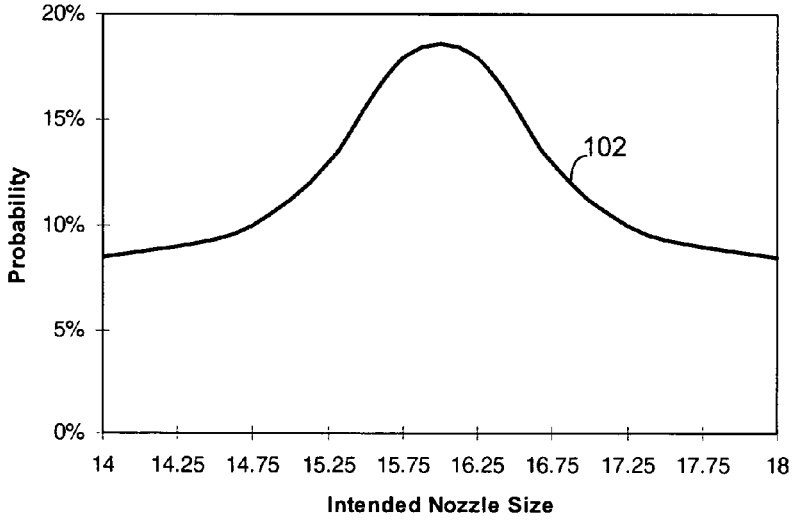

FIG. 8
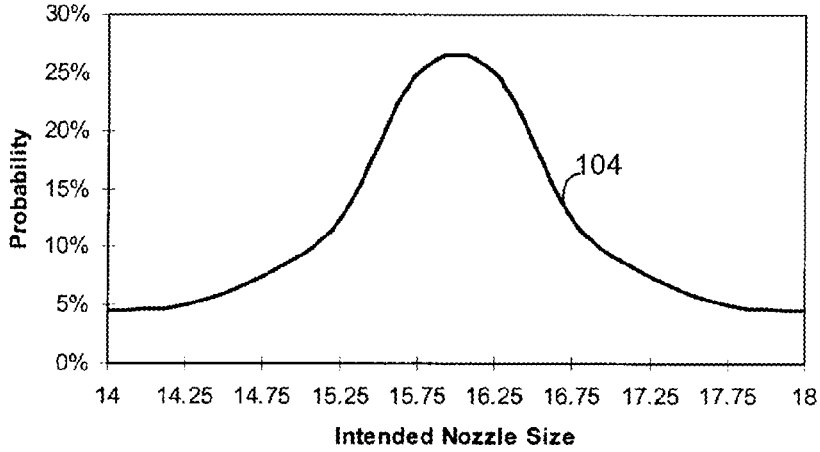
FIG. 9
| TABLE 3 – Normal Probability Distribution | |
|---|---|
| **Subinterval (micrometers)** | **Probability (%)** |
| [14, 14.5) | 5 |
| [14.5, 15) | 7.5 |
| [15, 15.5) | 12.5 |
| [15.5, 16) | 25 |
| [16, 16.5) | 25 |
| [16.5, 17) | 12.5 |
| [17, 17.5) | 7.5 |
| [17.5, 18] | 5 |
FIG. 10
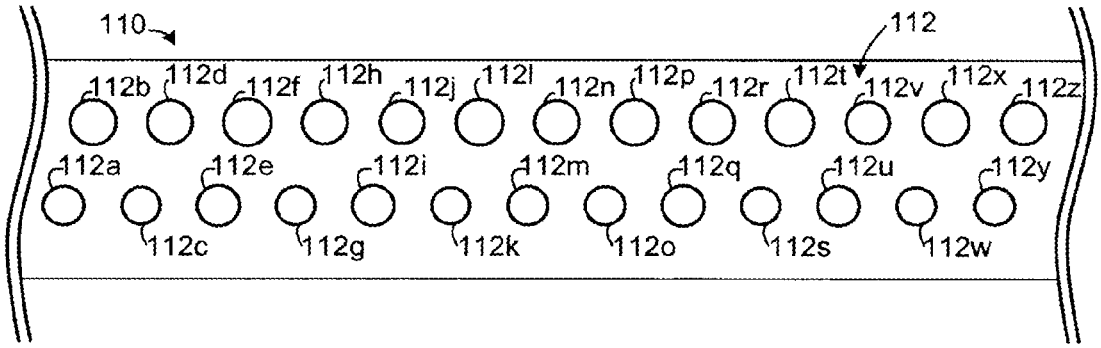

| TABLE 4 – Nozzle Size and Position | | | | | |
|---|---|---|---|---|---|
| Nozzle | Nozzle Position | Size (micrometers) | Nozzle | Nozzle Position | Size (micrometers) |
| 112a | 1 | 15.0 | 112n | 14 | 16.6 |
| 112b | 2 | 17.1 | 112o | 15 | 14.9 |
| 112c | 3 | 14.4 | 112p | 16 | 17.3 |
| 112d | 4 | 16.8 | 112q | 17 | 15.8 |
| 112e | 5 | 15.7 | 112r | 18 | 16.5 |
| 112f | 6 | 17.8 | 112s | 19 | 14.3 |
| 112g | 7 | 14.8 | 112t | 20 | 17.7 |
| 112h | 8 | 16.7 | 112u | 21 | 15.4 |
| 112i | 9 | 15.6 | 112v | 22 | 16.0 |
| 112j | 10 | 16.4 | 112w | 23 | 14.5 |
| 112k | 11 | 14.1 | 112x | 24 | 17.0 |
| 112l | 12 | 17.5 | 112y | 25 | 14.6 |
| 112m | 13 | 15.0 | 112z | 26 | 16.4 |

| TABLE 5 – Uniform Nozzle Distribution | |
|---|---|
| Subinterval | Number of Nozzles within Subinterval |
| [14, 14.5) | 3 |
| [14.5, 15) | 4 |
| [15, 15.5) | 3 |
| [15.5, 16) | 3 |
| [16, 16.5) | 3 |
| [16.5, 17) | 4 |
| [17, 17.5) | 3 |
| [17.5, 18] | 3 |

| TABLE 6 – Nozzle Size and Position | | | | | |
|---|---|---|---|---|---|
| Nozzle | Nozzle Position | Size (micrometers) | Nozzle | Nozzle Position | Size (micrometers) |
| 152a | 1 | 16.4 | 152n | 14 | 17.3 |
| 152b | 2 | 15.1 | 152o | 15 | 15.7 |
| 152c | 3 | 17.6 | 152p | 16 | 16.2 |
| 152d | 4 | 15.6 | 152q | 17 | 15.4 |
| 152e | 5 | 16.8 | 152r | 18 | 16.1 |
| 152f | 6 | 14.4 | 152s | 19 | 15.9 |
| 152g | 7 | 15.7 | 152t | 20 | 17.2 |
| 152h | 8 | 16.1 | 152u | 21 | 15.0 |
| 152i | 9 | 15.5 | 152v | 22 | 16.3 |
| 152j | 10 | 16.9 | 152w | 23 | 15.5 |
| 152k | 11 | 15.4 | 152x | 24 | 16.6 |
| 152l | 12 | 16.2 | 152y | 25 | 14.6 |
| 152m | 13 | 14.9 | 152z | 26 | 16.0 |

| TABLE 7 – Normal Nozzle Distribution | |
|---|---|
| Subinterval | Number of Nozzles within Subinterval |
| [14, 14.5) | 1 |
| [14.5, 15) | 2 |
| [15, 15.5) | 4 |
| [15.5, 16) | 6 |
| [16, 16.5) | 7 |
| [16.5, 17) | 3 |
| [17, 17.5) | 2 |
| [17.5, 18] | 1 |

| TABLE 8 – Usage Pattern | | | | | | | | |
|---|---|---|---|---|---|---|---|---|
| | Die | | | | | | | |
| | A | | B | | C | | D | |
| | small | large | small | large | small | large | small | large |
| Intended Drop Volume | 5.0 | 7.0 | 5.0 | 7.0 | 5.0 | 7.0 | 5.0 | 7.0 |
| Actual Drop Volume | 5.4 | 7.3 | 4.5 | 6.2 | 5.2 | 7.6 | 5.1 | 6.9 |
| Uncalibrated Mean Drop Volume | 6.35 | | 5.35 | | 6.40 | | 6.00 | |
| Firing Ratio | 68% | 32% | 12% | 88% | 67% | 33% | 50% | 50% |
| Calibrated Mean Drop Volume | 6.00 | | 6.00 | | 5.99 | | 6.00 | |

NOZZLE DISTRIBUTION

CROSS-REFERENCE TO RELATED APPLICATION

This is a continuation of application Ser. No. 10/769,252 filed on Jan. 30, 2004, now U.S. Pat. No. 7,249,815, which is hereby incorporated by reference.

BACKGROUND

Printing systems can be configured to eject ink onto paper to generate a desired image. In general, increased resolution and improved color accuracy create more realistic and/or desirable images. Therefore, many printing systems are designed to increase resolution and/or improve color accuracy. The ability to print images in a short period of time is also generally a favorable attribute of a printing system. Accordingly, some printing systems are designed to increase printing speed.

BRIEF DESCRIPTION OF THE DRAWINGS

FIG. 4 is a plot showing an embodiment a uniform probability distribution within a boundary interval.

FIG. 5 is a table listing the probability that a nozzle sized according to the uniform probability distribution of FIG. 4 will be configured with an intended nozzle size in a subinterval of the boundary interval of FIG. 4.

FIG. 6. is a plot showing an embodiment a normal probability distribution within a boundary interval.

FIG. 7 is a table listing the probability that a nozzle sized according to the embodiment of the normal probability distribution of FIG. 6 will be configured with an intended nozzle size in a subinterval of the boundary interval of FIG. 6.

FIG. 8. is a plot showing another embodiment of a normal probability distribution within a boundary interval.

FIG. 9 is a table listing the probability that a nozzle sized according to the normal probability distribution of FIG. 8 will be configured with an intended nozzle size in a subinterval of the boundary interval of FIG. 8.

FIG. 10 is a layout view showing an embodiment of a die including a plurality of nozzles having a variety of intended nozzle sizes that are selected according to a predetermined intended distribution based on a uniform probability distribution.

DETAILED DESCRIPTION

Figure 1:
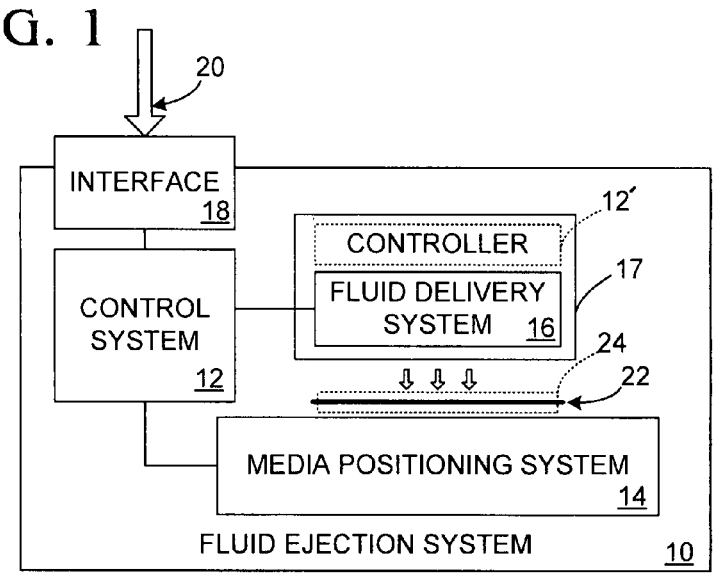
FIG. 1 is a schematic view of an embodiment of a fluid ejection system.

FIG. 1 schematically shows a fluid ejection system 10. Although fluid ejection systems can be configured to eject a variety of different fluids in various embodiments, this disclosure focuses on an exemplary printing system that is used to eject, or print, ink onto paper. However, it should be understood that other printing systems, as well as fluid ejection systems designed for nonprinting applications, are also within the scope of this disclosure.

Fluid ejection system 10 includes a control system 12, a media positioning system 14, a fluid delivery system 16, and a control interface 18. Control system 12 can include componetry, such as a printed circuit board, processor, memory, application specific integrated circuit, etc., which effectuates fluid ejection corresponding to received fluid ejection information 20. Fluid ejection information may be received via a wired or wireless control interface 18, or other suitable mechanism. The fluid ejection information may include instructions to perform a desired fluid ejection process or may provide pattern information which can be converted into signals for actuating the fluid ejection elements, e.g. nozzles, of fluid ejection system 10. Although control system 12 and fluid delivery system 16 are shown in FIG. 1 as separate systems, it will be appreciated that one or more components of the control system may be combined with the fluid delivery system to define a unitary fluid ejection device, such as a print cartridge. For example, the unitary fluid ejection device 17 may include a controller 12' (shown in dashed lines) and fluid delivery system 16.

Upon receiving fluid ejection information, one or more components of control system 12 can cause media positioning system 14 and fluid delivery system 16 to cooperate to eject fluid onto a medium 22. As one example, fluid ejection information may include a print job defining a particular image to be printed. The control system may interpret the fluid ejection information, e.g. a print job for a printer, and cause fluid, such as ink, to be ejected onto paper in a pattern replicating the image defined by the print job.

Media positioning system 14 can control the relative positioning of the fluid delivery system and a medium onto which the fluid is to be placed. For example, media positioning system 14 can include a paper feed that advances paper through a printing zone 24 of the fluid delivery system. The media positioning system can additionally or alternatively include a mechanism for laterally positioning a printhead, or other suitable device, for ejecting fluid to different areas of the printing zone. The relative position of the medium and the fluid delivery system can be controlled so that fluid is ejected onto only a desired portion of the medium. In some embodiments, media positioning system 14 can be selectively configurable to accommodate two or more different types and/or sizes of media. While the above description refers to media positioning system 14 as controlling media it can position non-media items and the like. In some embodiments fluid delivery system 16 may move while media is held stationary by media positioning system 14. In other embodiments, media positioning system 14 may move media while fluid delivery system 16 is also moved.

Figure 2:
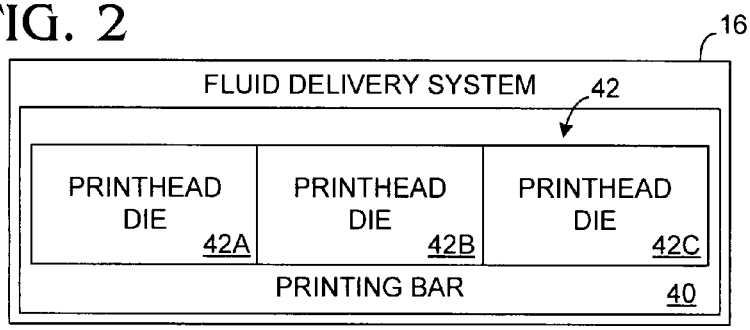
FIG. 2 is a schematic view of an embodiment of a fluid delivery system of the embodiment of the fluid ejection system of FIG. 1.
Figure 3:
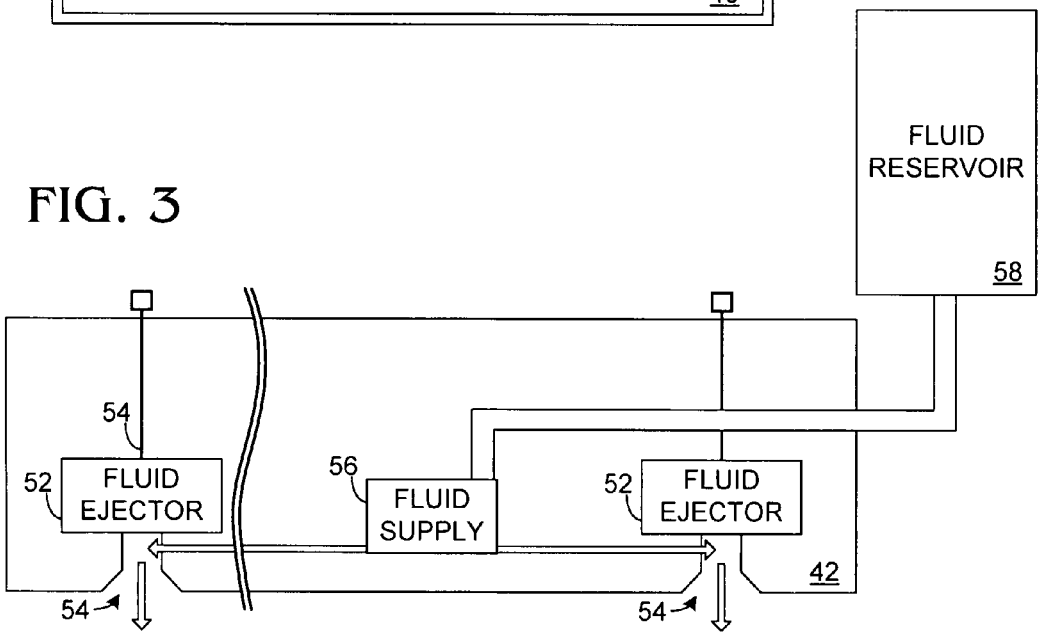
FIG. 3 is a schematic view of a portion of a die of the embodiment of the fluid delivery system of FIG. 2.

FIG. 2 schematically shows a fluid delivery system 16 that includes a printing bar 40 that in turn includes a plurality of die 42, such as die 42*a*, 42*b*, and 42*c*. A printing bar can be used to print across a relatively wide area, such as an entire width of printing zone 24, thus limiting a need to scan a fluid delivery system across the printing zone. As shown in FIG. 3 with reference to a portion of a printhead die 42, a die can include a plurality of fluid ejection elements 52, such as heating elements, which actuate fluid ejection through a plurality of nozzles 54. The die can also include a fluid supply mechanism 56 for positioning a volume of fluid in a position proximate a fluid ejector. The fluid delivery system can also include a fluid reservoir 58, which may be either part of a unitary fluid ejection device with die 42, e.g. a print cartridge, or may be a separate from die 42. The fluid reservoir replenishes fluid delivered to the fluid ejection elements by fluid supply mechanism 56. As indicated, fluid reservoir 58 can take the form of an off-axis fluid reservoir or an on-axis reservoir.

Fluid delivered from the fluid reservoir to a fluid ejector via the fluid supply mechanism can be selectively ejected in response to an ejection signal. A portion of the fluid moved proximate a fluid ejector may be ejected through a particular nozzle when the fluid ejector associated with that nozzle is activated, such as when a resistor is heated to vaporize the fluid to create a fluid bubble. As the bubble expands, some of the fluid may be ejected out of the corresponding nozzle. When the fluid bubble collapses, fluid from the fluid supply is drawn to the nozzle for subsequent ejection, via a vacuum force and/or other means. In some embodiments, the fluid ejection elements can include components that effectuate fluid ejection via a nonthermal mechanism, such as fluid ejection elements that utilize vibration to eject fluid.

Each die 42 can be configured to receive or generate ejection signals via conductive paths that lead to the fluid ejection elements. A fluid ejection device, such as a print cartridge, can include a controller for routing and/or generating current to the individual fluid ejection elements based on received instructions. Current can be directed through an individual fluid ejector, thus causing that particular fluid ejector to eject fluid through a corresponding nozzle. The controller can include a plurality of logic gates including transistors and/or other circuit components designed to route the current according to received instructions, thus allowing selected nozzles to be selectively fired. As used herein, "controller" describes the portion of the control system that is located on the fluid ejection device.

Nozzles can be individually dimensioned to eject printing fluid with a desired drop volume, or at least within a desired range of drop volumes. Precisely manufacturing all nozzles of a die to eject exactly the same drop volume may occur. Variations in manufacturing procedures and materials can lead to drop volumes that vary between nozzles. A characteristic referred to as the "mean drop volume" or "mean drop weight" is used to refer to the average drop volume ejected from all active nozzles of a die. The mean drop volume of a die determines characteristics of a printed image, such as the chroma, saturation and density of the image. Individual dies of a printing bar can be designed to have the same mean drop volume. Similarly, individual dies of different printheads can be designed to have the same mean drop volume.

A die can be configured with a plurality of variously sized nozzles, which are configured to eject printing fluid with different relative drop volumes or within different ranges of drop volumes. In other words, individual nozzles of a die can be purposefully configured with different intended sizes. As mentioned above, variations in manufacturing materials and procedures may introduce further variations in the actual size of the nozzles. However, on average, the actual size of a nozzle is typically very close to the intended size of the nozzle. Therefore, nozzles designed with larger intended sizes will typically have larger actual sizes than nozzles designed with smaller intended sizes. In other words, nozzles with larger intended sizes will typically eject printing fluid having larger drop volumes than drop volumes of printing fluid ejected from nozzles with smaller intended sizes. A plurality of variously sized nozzles may be used to eject the same type and/or color of printing fluid.

As used herein, "nozzle size" is intended to describe all attributes of a fluid ejection element that affect drop volume. Parameters that may be varied to accomplish this include, but are not limited to, nozzle diameter, nozzle shape, chamber shape, chamber depth, and/or chamber volume. Furthermore, aspects other than dimensional attributes, such as the timing and/or magnitude of the ejection signal, may be used to control ejected drop volume.

A predetermined intended distribution can be used to select the different intended sizes of the nozzles and/or the intended drop volume of printing fluid ejected from the nozzles. A predetermined intended distribution can include two or more different sizes of nozzles. For example, a predetermined intended distribution may be characterized by a maximum nozzle size and a minimum nozzle size. Accordingly, a predetermined intended distribution can effectively define a range of intended nozzle sizes bound by the minimum and maximum sizes. Such a range may be referred to as the boundary interval, i.e. one that is defined by a higher and lower nozzle size, of the predetermined intended distribution. As one nonlimiting example of varying nozzle diameter, a boundary interval of nozzle diameters of the predetermined intended distribution may be greater than or equal to 14 micrometers and less than or equal to 18 micrometers. It should be understood that the boundary interval [14, 18] is provided as a nonlimiting example, and other boundary intervals are also within the scope of this disclosure. In some embodiments, a boundary interval may be selected to correspond to a particular type and/or color of printing fluid (e.g. ink, pre-conditioner, fixer, etc.). Accordingly, some types and/or colors of printing fluids may be ejected from dies that are based on predetermined intended distributions having different boundary intervals than other types and/or colors of printing fluid.

For example, boundary interval [14, 18] can be divided into the following subintervals: [14, 14.5), [14.5, 15), [15, 15.5), [15.5, 16), [16, 16.5), [16.5, 17), [17, 17.5), [17.5, 18], where each of the values represents a diameter of a nozzle in micrometers. It should be understood that a boundary interval could alternatively be divided into more or fewer subintervals than the exemplary boundary interval described above. The number and range of subintervals may be selected in order to perform a desired analysis on the predetermined intended distribution.

A predetermined intended distribution may be based on a probability distribution, such as a normal distribution, uniform distribution, gamma distribution, binary distribution, etc. A probability distribution can define the relative probability that a nozzle will be sized within a particular subinterval, and/or a probability distribution may continuously define the relative probability that a nozzle will be a particular size within a given boundary interval. In some embodiments, a probability distribution defines the relative probability that a given nozzle will eject printing fluid having a particular intended drop volume. A predetermined intended distribution may be based on one or more parameters for weighting the selection of actual nozzle sizes and/or intended drop volumes according to a particular probability distribution.

FIG. 4 shows an exemplary uniform probability distribution 100, on which a predetermined intended distribution may be based. Table 1 of FIG. 5 shows uniform probability distribution 100 in table form, defining the net probability that a nozzle will have an intended size in each of several subintervals of the boundary interval [14, 18]. As can be seen, uniform probability distribution 100 dictates that each nozzle is equally likely to be a particular size within each of the different subintervals.

FIG. 6 graphically plots a first normal distribution 102, and Table 2 of FIG. 7 shows normal probability distribution 102 in table form, defining the net probability that a nozzle will have an intended size in each of several subintervals of the boundary interval [14, 18]. According to first normal probability distribution 102, a nozzle is at least twice as likely to be sized near the middle value of the boundary interval than near the minimum or maximum values of the boundary interval.

FIG. 8 and Table 3 of FIG. 9 show a second normal distribution 104. Compared to first normal probability distribution 102, the second normal probability distribution is more heavily weighted toward the middle of the boundary interval. In other words, there is a relatively greater chance that a nozzle will have a size near the middle value of the boundary interval than near the minimum or maximum values of the boundary interval.

The above are provided as nonlimiting examples of probability distributions on which a predetermined intended distribution can be based. Other probability distributions are within the scope of this disclosure. A particular probability distribution can be selected to achieve a desired printing characteristic. Furthermore, though described with reference to the boundary interval [14, 18], it should be understood that a probability distribution may be configured for virtually any boundary interval. Though above described with reference to continuous probability distributions, it is also within the scope of this disclosure to use a predetermined intended distribution that is based on a discrete probability distribution. As nonlimiting examples, a predetermined intended distribution may be based on a probability distribution in which [14, 14]=10%, [15, 15]=20%, [16, 16]=40%, [17, 17]=20%, and [18, 18]=10%; or a predetermined intended distribution may be based on a binary probability distribution in which [15, 15]=50% and [17, 17]=50%.

A predetermined intended distribution may, in addition nozzle size, also define a nozzle pattern that defines the physical location of each of the variously sized nozzles on a die. Such a pattern may be designed to intermix the positions of relatively large nozzles with the positions of relatively small nozzles. As explained in more detail below, commonly sized nozzles may be controlled as a group, and limiting the physical proximity and/or repetitiveness of such nozzles can help limit printing artifacts. Nozzles of various sizes may be patterned so that mean drop volumes are substantially balanced across the area of a die. Furthermore, the nozzles can also have a pattern of positions so that mean drop volumes remain substantially balanced across the area of the die, even when the mean drop volume of the die is changed. In some embodiments, nozzle pattern may initially be randomly selected. However, the same randomly selected nozzle pattern may be purposefully used to repeatedly model the nozzle pattern of a plurality of dies.

A die may be constructed with nozzles that are variously sized and/or patterned according to a predetermined intended distribution. In some embodiments, a computer can be used to calculate each of the nozzle sizes and/or positions according to the predetermined intended distribution. Such a computer may be programmed to generate a nozzle map, which defines the intended size and placement of each nozzle that is to be established on a die. As mentioned above, the actual nozzle size may slightly vary from the intended nozzle size that is selected according to the predetermined intended distribution. A computer may be programmed to generate a nozzle map with limited or no perceptible trends and/or patterns which could lead to printing artifacts. Although described in the context of a computer using a predetermined intended distribution to calculate nozzle size and position, it should be understood that other methods of using a predetermined intended distribution to determine the size and/or position of nozzles are also within the scope of this disclosure.

FIG. 10 shows a portion of a die 110, which includes a plurality of nozzles 112 (112*a*-112*z*) that are variously sized and positioned according to a predetermined intended distribution based on a uniform probability distribution. It should be understood that the illustrated embodiment includes a limited number of nozzles, and that a die may be configured with many more nozzles in some embodiments. Similarly, the illustrated embodiment shows two rows of nozzles, and a die may include more or fewer rows of nozzles. Because of the uniform probability distribution on which the predetermined intended distribution is based, the sizes of nozzles 112 are substantially equally distributed throughout the range of nozzle sizes set forth by the boundary interval [14, 18].

Figures 11, 12, 13:
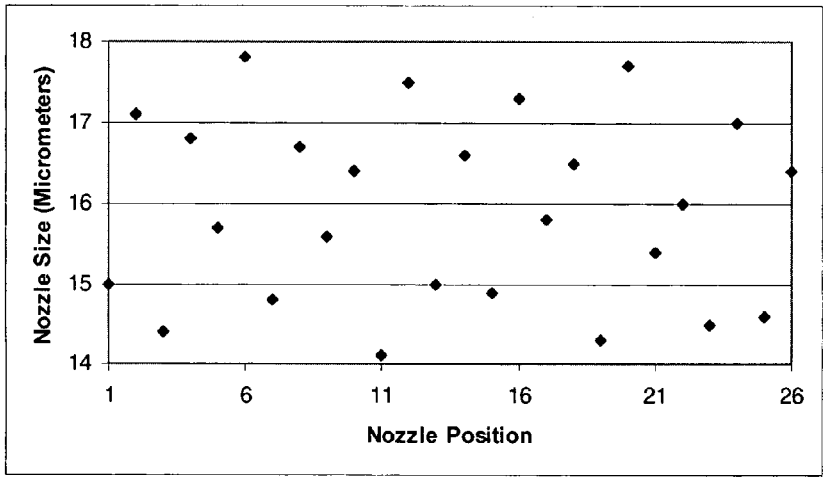
FIG. 11 is a table listing the nozzle position and intended nozzle size for each of the nozzles of the embodiment of FIG. 10.
FIG. 12 is a table showing how many of the nozzles of the embodiment of FIG. 10 have an intended size in each of several subintervals.
FIG. 13 is a plot showing the distribution of intended nozzle sizes on the die of the embodiment of FIG. 10.

Table 4 of FIG. 11 lists the nozzle position and intended nozzle size for each of nozzles 112. Table 5 of FIG. 12 shows the generally uniform distribution of intended nozzle sizes of die 110. FIG. 13 is a plot that shows the relative intended size of each nozzle along the length of the die. The nozzles of die 110 have a nozzle pattern in which relatively large and relatively small nozzles are intermixed. Intermixing nozzles of different sizes can help limit perceptible repetition that could lead to printing artifacts. For example, intermixing large and small nozzles can reduce the likelihood that adjacent nozzles are simultaneously masked completely and/or used at less than full capacity when changing a mean drop volume of the die.

Figures 14, 15, 16:
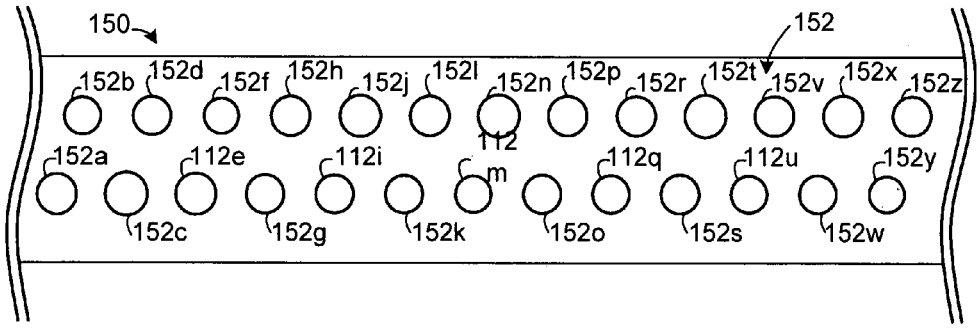
FIG. 14 is a layout view showing an embodiment of a die including a plurality of nozzles having a variety of intended nozzle sizes that are selected according to a predetermined intended distribution based on a normal probability distribution.
FIG. 15 is a table listing the nozzle position and intended nozzle size for each of the nozzles of the embodiment of FIG. 14.
FIG. 16 is a table showing how many of the nozzles of the embodiment of FIG. 14 have an intended size in each of several subintervals.
Figures 17, 18:
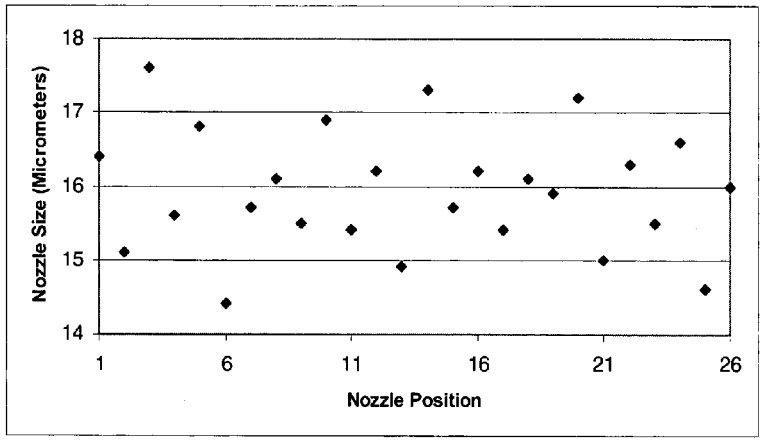
FIG. 17 is a plot showing the distribution of intended nozzle sizes on the die of the embodiment of FIG. 14.
FIG. 18 is a table showing selective firing ratios used to calibrate exemplary dies that are configured to eject printing fluid having a mean drop volume based on a binary probability distribution.

FIG. 14 shows a portion of a die 150, which includes a plurality of nozzles 152 (152*a*-152*z*) that are variously sized and positioned according to a predetermined intended distribution based on a normal probability distribution. Whereas the nozzles of die 110 are substantially equally distributed throughout the range of nozzle sizes, a relatively large percentage of nozzles 152 are sized toward the middle of the boundary interval [14, 18]. Conversely, a relatively small percentage of nozzles 152 are sized toward the maximum and minimum sizes of the boundary interval [14, 18]. Such a distribution may be referred to as being center weighted. Table 6 of FIG. 15 lists the nozzle position and intended nozzle size for each of nozzles 152. Table 7 of FIG. 16 shows the generally normal distribution of intended nozzle sizes of die 150. FIG. 17 shows the relative intended size of each nozzle along the length of the die. As can be seen in FIG. 17, the nozzle sizes of die 150 are center weighted.

Two or more different nozzle maps may be generated using the same nozzle distribution. In some embodiments, a predetermined intended distribution may have a level of randomness, which leads to slightly different nozzle maps based on the same predetermined intended distribution. This provides substantial design freedom in selecting a nozzle map that is used to construct dies. One level of design freedom includes selecting a particular predetermined intended distribution. Such a predetermined intended distribution may be designed with one or more parameters that are different than the parameters of other predetermined intended distributions. Such parameters may include any suitable parameter, including but not limited to a boundary interval, mean, standard deviation, and/or probability distribution. A second level of design freedom includes selecting a particular nozzle map generated from the selected predetermined intended distribution. A particular nozzle map may be selected based on tested printing characteristics of dies constructed from the nozzle map.

A control system may be configured to repeatedly fire individual fluid ejection elements to generate a desired image. In particular, a control system can control individual fluid ejection elements according to a mask and/or pattern of use, which determines when and where each fluid ejector fires. In other words, the location at which each pixel of printing fluid is delivered on a medium may be determined by a mask and/or pattern of use, which effectuates ejection of printing fluid to that location when a desired nozzle is positioned to fire at that location. As mentioned above, the relative position of the medium and/or the fluid delivery system may be controlled, such as by advancing the medium through a printing zone that a printing bar is configured to cover. A mask and/or pattern of use can be used to control which nozzles are fired in such a way as to reduce undesirable printing artifacts. As described in more detail below, a mask and/or pattern of use may include a plurality of submasks and or patterns of use that collectively determine when and where each fluid ejector fires.

A mask and/or pattern of use may selectively vary the timing of drops fired from selected nozzles. For example, the firing frequency of one or more of the nozzles can be varied to set a mean drop volume of a die. Nozzles can be controlled so that they do not fire, or nozzles can be controlled to fire at less than full frequency. Individual nozzles may be controlled in this manner, or sets of two or more nozzles may be selectively controlled as a group. In particular, nozzles sharing a common dimensional characteristic may be controlled as a group, independently of other nozzles having a different dimensional characteristic. For example, nozzles within a subinterval, such as [14, 14.5) or [17.5, 18], may be collectively controlled as a group. A look-up table can be used to store the intended size of each nozzle, and the control system can be used to generate a use pattern based upon color transitions and image densities, which could change during the printing of a particular image.

As demonstrated in FIGS. 10-17, nozzles may be arranged along a die in a variety of patterns with a variety of nozzle sizes. Such nozzles can be arranged according to a nozzle map, which is generated according to a predetermined intended distribution. The nozzle map defines the intended size and location for each nozzle. Because the intended size at least generally corresponds to the actual size, the nozzle map generally tracks where on a die the actual relatively large and relatively small nozzles are located. Therefore, a predetermined intended distribution can be used to produce a die with differently sized nozzles, in which the actual relative size of at least some of the nozzles may be distinguishable from the actual relative size of at least some of the other nozzles.

Two or more dies based on the same or a different predetermined intended distribution may be used to collectively form a printing bar. Such a printing bar may be tested by printing, from each die of the printing bar, a test swath intended to have the same density. The swath from each die may be compared to one another. If the density of one swath does not match the density of another swath, selected nozzles of one or more of the dies may be selectively fired to shift the mean drop volume of the dies to match each other. Similarly, two or more dies based on the same or a different predetermined intended distribution may be used in different printheads. The printheads may be calibrated by printing, from the die of each printhead, a test swath intended to have the same density. The swath from each printhead may be compared to one another. If the density of one swath does not match the density of another swath, selected nozzles of one or more of the dies from the different printheads may be selectively fired to shift the mean drop volume of the printheads to match each other.

In order to shift the mean drop volume of a die to a relatively low mean drop volume, nozzles having a relatively large intended size may be selectively fired at less than full frequency. Conversely, a relatively high mean drop volume may be achieved by selectively firing nozzles having a relatively small intended size. Of course, firing all nozzles at full frequency can produce an even higher mean drop volume. Such selection of firing frequency may be applied in addition to any other controls, masks, and/or patterns of use used to produce a desired image. A predetermined intended distribution may be configured to produce a nozzle map that has sufficient redundancy so that there is sufficient drop volume and spacing to avoid perceptible printing artifacts and/or other deficiencies when the nozzles are selectively fired to shift the mean drop volume.

As a nonlimiting example, a 1200 dpi die can be configured with two 600 dpi columns. The nozzles of the die can be configured to produce drops having a variety of volumes according to a predetermined intended distribution. In some embodiments, the nozzles can be configured according to a binary distribution designed to produce a target mean drop volume of 6.0 ng. As such, a first column can be configured to produce 5.0 ng drops and a second column can be configured to produce 7.0 ng drops. When the die is used to print at 600 dpi, pairs of nozzles including one nozzle from the first column and one nozzle from the second column can cooperate to eject printing fluid. If the actual drop volume of a nozzle of the first column is 5.0 ng and the actual drop volume of a paired nozzle from the second column is 7.0 ng, thereby resulting in a mean drop volume of 6.0 ng, each nozzle can be used 50% of the time. If the actual mean drop volume is relatively lower, the higher drop volume column can be used a greater proportion of the time. If the actual mean drop volume is relatively higher, the lower drop volume column can be used a greater proportion of the time.

Table 8 of FIG. 18 provides examples of possible patterns of use that may be used to calibrate a die that has a plurality of nozzles configured to eject printing fluid having drop volumes based on a binary probability distribution. The table shows four dies A-D, which each include nozzles configured to eject relatively small drops and nozzles configured to eject relatively large drops. As mentioned above, the actual drop volume from a nozzle may be different than the intended drop volume. However, by adjusting a firing ratio that controls proportional firing between nozzles of different sizes, the effective mean drop volume can be shifted to approximately the mean intended drop volume. Table 8 demonstrates this concept with reference to a simple binary probability distribution. However, selective nozzle firing may be used with virtually any predetermined intended distribution to calibrate mean drop volume. In general, the relative proportion of different nozzle firings can be adjusted to achieve a desired mean drop volume, even for die based on relatively complicated predetermined intended distributions.

Although the present disclosure has been provided with reference to the foregoing operational principles and embodiments, it will be apparent to those skilled in the art that various changes in form and detail may be made without departing from the spirit and scope defined in the appended claims. The present disclosure is intended to embrace all such alternatives, modifications and variances. Where the disclosure or claims recite "a," "a first," or "another" element, or the equivalent thereof, they should be interpreted to include one or more such elements, neither requiring nor excluding two or more such elements.

What is claimed is:

1. A fluid ejection device, comprising:

an individual die including a plurality of nozzles variously configured according to a predetermined distribution, the plurality of nozzles of the individual die having a target mean drop volume and an actual mean drop volume, wherein a first subset of the plurality of nozzles of the individual die has a mean drop volume larger than the mean drop volume of a second subset of the plurality of nozzles of the individual die; and a controller configured to set the actual mean drop volume provided by the plurality of nozzles of the individual die to the target mean drop volume by selectively firing nozzles of the first subset of the plurality of nozzles of the individual die having the larger mean drop volume, wherein the plurality of nozzles are arranged on the die such that nozzles of the first subset are pseudorandomly intermixed with nozzles of the second subset.

2. The fluid ejection device of claim 1, wherein the predetermined distribution is characterized by a random distribution of nozzle sizes.

3. The fluid ejection device of claim 1, wherein the predetermined distribution is based on a uniform distribution of nozzle sizes.

4. The fluid ejection device of claim 1, wherein the predetermined distribution is based on a normal distribution of nozzle sizes.

5. The fluid ejection device of claim 1, wherein the predetermined distribution is based on a binary distribution of nozzle sizes.

6. The fluid ejection device of claim 1, wherein the plurality of nozzles are arranged to avoid visually perceptible printing artifacts.

7. A fluid ejection device, comprising:

a die including a plurality of nozzles variously configured according to a predetermined distribution, the plurality of nozzles having a target mean drop volume and an actual mean drop volume, wherein a first subset of the plurality of nozzles has a mean drop volume larger than the mean drop volume of a second subset of the plurality of nozzles; and a controller configured to set the actual mean drop volume provided by the plurality of nozzles to the target mean drop volume by selectively firing nozzles of the first subset of nozzles, wherein the plurality of nozzles are arranged on the die so that large nozzles are pseudorandomly intermixed with small nozzles.

8. The fluid ejection device of claim 7, wherein the plurality of nozzles are arranged to avoid visually perceptible printing artifacts.

9. A fluid ejection system, comprising:

an individual die including a plurality of nozzles variously configured according to a predetermined distribution, the plurality of nozzles of the individual die having a target mean drop volume and an actual mean drop volume, wherein a subset of the plurality of nozzles of the individual die are sized smaller than others of the plurality of nozzles of the individual die; and a control system configured to set the actual mean drop volume provided by the plurality of nozzles of the individual die to the target mean drop volume by selectively firing nozzles of the subset of the plurality of nozzles of the individual die sized smaller than the others of the plurality of nozzles of the individual die, wherein the plurality of nozzles are arranged on the die so that large nozzles are pseudorandomly intermixed with small nozzles.

10. The fluid ejection system of claim 9, wherein the predetermined distribution is characterized by a random distribution of nozzle sizes.

11. The fluid ejection system of claim 9, wherein the predetermined distribution is based on a uniform distribution of nozzle sizes.

12. The fluid ejection system of claim 9, wherein the predetermined distribution is based on a normal distribution of nozzle sizes.

13. The fluid ejection system of claim 9, wherein the predetermined distribution is based on a binary distribution of nozzle sizes.

14. The fluid ejection system of claim 9, wherein the plurality of nozzles are arranged to avoid visually perceptible printing artifacts.

15. A fluid ejection system, comprising:

a die including a plurality of nozzles variously configured according to a predetermined distribution, the plurality of nozzles having a target mean drop volume and an actual mean drop volume, wherein a subset of the plurality of nozzles are sized smaller than others of the plurality of nozzles; and a control system configured to set the actual mean drop volume provided by the plurality of nozzles to the target mean drop volume by selectively firing nozzles of the subset nozzles, wherein the plurality of nozzles are arranged on the die so that large nozzles are pseudorandomly intermixed with small nozzles.

16. The fluid ejection system of claim 15, wherein the plurality of nozzles are arranged to avoid visually perceptible printing artifacts.

17. A fluid ejection device, comprising:

a die including a plurality of nozzles configured with various sizes that are selected according to a predetermined distribution that defines at least a boundary interval of nozzle sizes and a probability distribution of nozzle sizes, the plurality of nozzles including different subsets of nozzles of different sizes with each respective subset including substantially commonly sized nozzles, the die having a target mean drop volume and an actual mean drop volume; and a control system configured to set the actual mean drop volume of the die to the target mean drop volume of the die by selectively firing nozzles of selected different subsets of nozzles of the die having the different sizes of nozzles, wherein the plurality of nozzles are arranged on the die such that larger sized nozzles are pseudorandomly intermixed with smaller sized nozzles.

18. The fluid ejection device of claim 17, wherein the predetermined distribution defines a uniform probability distribution of intended nozzle sizes.

19. The fluid ejection device of claim 17, wherein the predetermined distribution defines a normal probability distribution of intended nozzle sizes.

20. The fluid ejection device of claim 17, wherein the predetermined distribution defines a binary probability distribution of intended nozzle sizes.

21. A fluid ejection device, comprising:

a die including a plurality of nozzles configured with various sizes that are selected according to a predetermined distribution that defines at least a boundary interval of nozzle sizes and a probability distribution of nozzle sizes, the plurality of nozzles including subsets of nozzles with each subset including substantially commonly sized nozzles, the die having a target mean drop volume and an actual mean drop volume; and a control system configured to set the actual mean drop volume of the die by selectively firing nozzles of selected subsets of nozzles of the die, wherein the plurality of nozzles are arranged on the die such that larger sized nozzles are pseudorandomly intermixed with smaller sized nozzles.

* * * * *